United States Patent [19]

Kerry et al.

[11] Patent Number: 4,681,228

[45] Date of Patent: Jul. 21, 1987

[54] PACKAGE FILLED WITH A WATER-SOLUBLE TOXIC PULVERULENT OR GRANULAR PRODUCT

[75] Inventors: Peter R. Kerry, Burpham; Jeffrey L. Lewis, Farnham, both of Great Britain

[73] Assignee: Koninklijke Emballage Industrie Van Leer B.V., Amstelveen, Netherlands

[21] Appl. No.: 818,492

[22] Filed: Jan. 13, 1986

[30] Foreign Application Priority Data

Jan. 14, 1985 [NL] Netherlands ..... 8500076

[51] Int. Cl.[4] ..... B65B 11/58; B65B 47/00; B65D 85/82

[52] U.S. Cl. ..... 206/484; 53/170; 53/173; 53/449; 206/524.7; 206/620

[58] Field of Search ..... 206/484, 524.1, 524.2.524.6, 206/524.7, 527, 602, 604, 610, 618, 620; 383/37; 53/170, 173, 449

[56] References Cited

U.S. PATENT DOCUMENTS

| | | | |
|---|---|---|---|
| 892,074 | 6/1908 | Obici | 206/618 |
| 3,216,566 | 11/1965 | Rosenthal | 206/524.1 |
| 3,294,224 | 12/1966 | Horwitz | 206/524.7 |
| 3,640,381 | 2/1972 | Kanada et al. | 206/620 |
| 3,892,905 | 7/1975 | Albert | 206/524.7 |
| 3,958,749 | 5/1976 | Goodrich | 206/618 |
| 4,226,330 | 10/1980 | Butler | 206/620 |
| 4,495,748 | 1/1985 | Rowell | 53/449 |
| 4,509,642 | 4/1985 | Rowell | 206/219 |

FOREIGN PATENT DOCUMENTS

| | | |
|---|---|---|
| 0049978 | 4/1982 | European Pat. Off. . |
| 0057768 | 8/1982 | European Pat. Off. . |
| 2202521 | 3/1974 | France . |
| 1054080 | 4/1982 | United Kingdom . |

*Primary Examiner*—William Price
*Assistant Examiner*—Jimmy G. Foster
*Attorney, Agent, or Firm*—Brumbaugh, Graves, Donohue & Raymond

[57] ABSTRACT

Some chemical products are so toxic that they must not come into contact with parts of the human body. A package of such a construction that during filling and transport thereof and during the release of product therefrom, the risk of anyone coming into contact with the product is restricted to a minimum, is characterized in that the product is situated in a closed inner container (1) consisting of a water-soluble flexible material, and that the filled inner container is placed inside a closed outer container (2) consisting of a flexible material which is resistant to water, both the inner container (1) and the outer container (2) consisting of a flexible tube which is closed near the two ends by a transverse joint (4 or 5 respectively) and the end strips (6) of the inner container are connected to the joining strips (5) of the outer container in a manner such that between the contents of the inner container and the said joining strips there is a certain distance, and that a tear line (7) is made in an exposed part of one of the end strips (6) of the inner container (1).

20 Claims, 4 Drawing Figures

PACKAGE FILLED WITH A WATER-SOLUBLE TOXIC PULVERULENT OR GRANULAR PRODUCT

The invention relates to a package filled with a water-soluble toxic pulverulent or granular product.

Some chemical products, in particular certain agricultural chemicals, are so toxic that they must not come into contact with parts of the human body. This requirement may present problems both in the filling of packages and in releasing the chemicals from the packages.

The object of the invention is in the first instance to contruct a package of the above type in a manner such that during the transport of the filled packages and during the release of the substance concerned from the packages, the risk of anyone coming into contact with the substance is restricted to a minimum.

According to the invention the toxic product is situated for this purpose in a closed inner container consisting of a water-soluble flexible material, the filled inner container is placed inside a closed outer container consisting of a flexible material which is resistant to water, both the inner container and the outer container consisting of a flexible tube which is closed near the two ends by a transverse joint and the end strips of the inner container are connected to the joining strips of the outer container in a manner such that between the contents of the inner container and the said joining strips there is a certain distance, and a tear line is made in an exposed part of one of the end strips of the inner container.

The outer container which is not separately filled with product forms a protection for the filled inner container against moisture and mechanical effects. In order to release the packed substance, the outer container is cut open and the inner container is deposited in water where the film of the inner container and the toxic filling dissolve.

Because the inner container is connected to the outer container in a manner such that it assumes an essentially fixed position in the outer container, good mechanical protection is achieved.

In order to simplify the removal of the inner container from the outer container the tear line is made in the joint between the inner and outer containers.

The filling of the packages without contact with the toxic substances may take place by making use of a device which consists of a first filling pipe, means for the metered supply of pulverulent or granular product to the filling pipe, means of placing around the first filling pipe a first continuous tube of film or laminate, means of making a transverse joint in the first tube and a tear line in the joint, a second fillling pipe for receiving the filled packages, means for placing a second continuous tube consisting of film or laminate around the second filling pipe and means for making a transverse joint in the second tube.

The said transverse joints are intended to be normal welded joints (heat seals), although beaded joints are not excluded.

The outer container could consist of a laminate of an optionally metallized film, kraft paper and a coating.

It is noted that packages consisting of an outer container made of film and an inner container made of film are known per se (U.S. Pat. No. 3,737,027), but in these known packages both containers are filled with a product, for example each with a component of a two-component resin. Moreover, the inner container is not manufactured from a water-soluble material. Use of this known package of toxic chemicals would not solve the problems pointed out above.

The invention will now be explained in more detail by reference to the figures.

Figure 4:
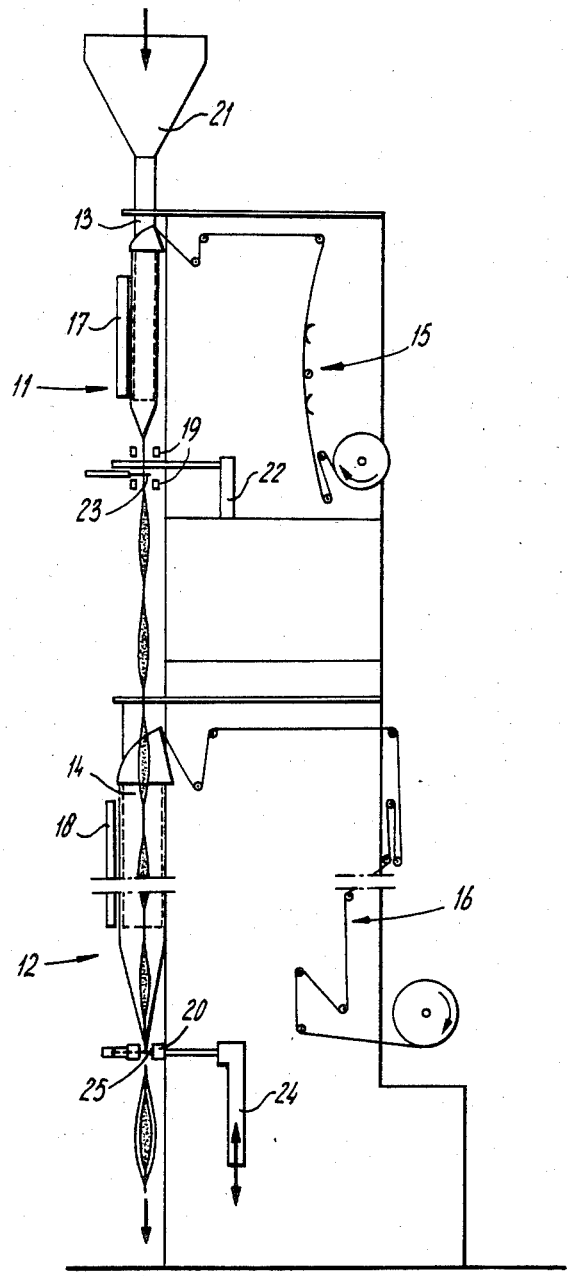

FIG. 4 provides a diagrammatic view of a device for the manufacture of the filled packages.

The invention is concerned with packages for toxic substances, for example agricultural chemicals, which must not come into contact with the human body both during the filling and packaging and during the transport of the packages and the release of the toxic substances from the packages.

Figure 1:
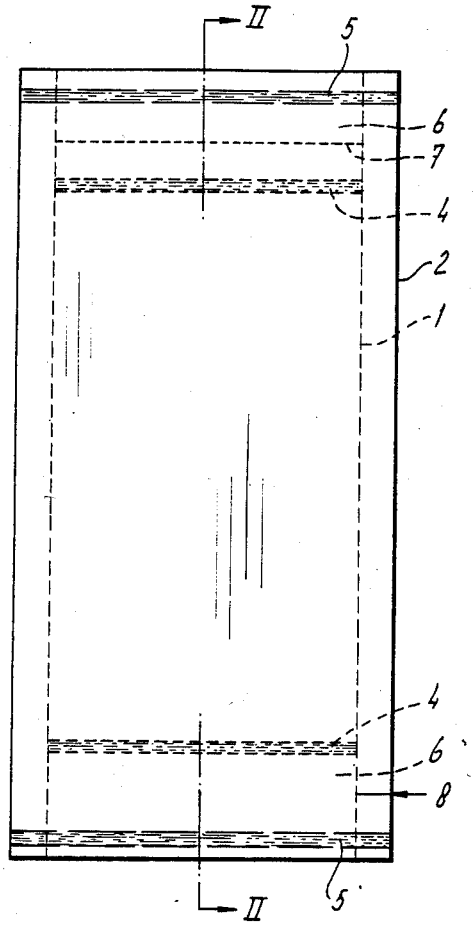
FIG. 1 shows a side view of a package according to the invention.
Figure 2:
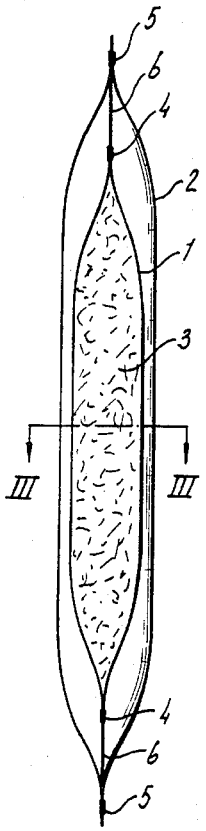
FIG. 2 shows a longitudinal cross-section along the line II—II in FIG. 1.
Figure 3:
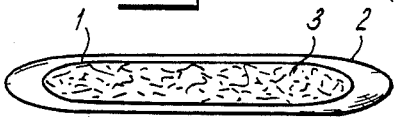
FIG. 3 shows a transverse cross-section along the line III—III in FIG. 2.

The packages shown in FIGS. 1, 2, 3 incl. comprise two containers 1, 2 consisting of plastic film or a laminate.

The inner container 1 is manufactured from a water-soluble material, for example from polyvinyl alcohol. It is filled with a water-soluble toxic powder or granular product 3. The outer container 2 acts as protection for the inner container 1 against moisture and mechanical effects. Naturally, the outer container is manufactured of a material which is resistant to water, for example a laminate of metallized polyester film, kraft paper and a coating of polyvinyl alcohol.

Both the inner and the outer containers consist of a tube which is closed at two ends by a transverse joint 4 or 5 respectively. The end strips 6 of the inner container 1 are connected at their ends to a transverse joint 5 of the outer container 2. In one of the end strips 6 a tear line 7 is perforated. The transverse joints are intended to be normal heat welds.

In order to use the contents of the package, the package should be cut through approximately at the position of the arrow 8, after which the filled inner container can be torn out of the outer container (making use of the tear line 7) and can be ejected into water. At room temperature the material of the inner container can dissolve in water in a short time (for example, 1 minute) and the toxic product 3 (for example, a granular herbicide) is released. Contact with the fingers or other parts of the body is entirely avoided.

To manufacture the said package use can be made of the device according to FIG. 4. This comprises two form-fill-seal (FFS) machines 11, 12 following each other. Each of the machines has a filling pipe 13 or 14 respectively, a supply device 15 or 16 respectively for packaging material which is wrapped around the filling pipe 13 or 14 respectively, a longitudinal welding device 17 or 18 respectively to weld the overlapping ends of the packaging material to each other to form a packaging tube, and transverse welding elements 19 or 20 respectively to close the inner tube and the outer tube respectively. The transverse welding elements 20 also serve to join the end strip 6 projecting beyond the transverse weld 4 of the inner container 1 to the outer container 2.

The filling pipe 13 is connected via a funnel 21 to a metering device for the metered supply of toxic pulverulent or granular material. This device may, inter alia, be controlled by feedback by means of a weighing device which weighs the finished packages and transmits corrective signals to the metering device.

The transverse welding elements 19 of the outer container are connected to a stationary support 22 and can only move perpendicularly to the direction of movement of the formed package. There are two pairs of transverse welding elements 19 between which a perforator 23 is situated for forming the tear line 7 in the packages.

On the other hand, there is only one pair of transverse welding elements 20 which is mounted on a support 24 movable vertically upwards and downwards. The elements 20 can move on the support 24 perpendicular to the direction of movement of the package. A knife 25 with a stop can be mounted in the elements 20 to separate the finished packages from each other.

It will be clear that the filling of the packages with a toxic substance takes place fully automatically and without human contact. As is made clear above, the dissolving of the toxic substance in water can also take place without contact with the hands.

EXAMPLE OF A PACKAGE

A package for 1 kg of granular herbicide having a density of 0.8–0.9 g/cm$^3$ and a grain size between 0.5 and 1.0 mm consisted of an outer container with a length of 385 mm and a width of 215 mm, the sheet from which the outer container was made having a width of 450 mm. The material of the outer container was a laminate of the following composition:

12 micron of metallized polyester film 40 g/m$^2$ kraft paper 35 g/m$^2$ of polyvinyl alcohol coating.

The inner package manufactured from a polyvinyl alcohol film having a thickness of 35 micron had a length of 275 mm and a width of 165 mm. The initial sheet had a width of 350 mm. This film could dissolve in water at ambient temperature within one minute. The film thickness can be somewhat greater, for example 50 or 70 micron.

It is important that the water-soluble container occupies a fixed position inside a flexible outer container resistant to water and that after the cutting open of the package the inner package with its dangerous contents remains inside the outer package until it is torn safely out of the outer container along the tear line.

Within the scope of the invention various changes are possible in the described package and manufacturing device.

We claim:

1. A package for a water-soluble pulverulent or granular product comprising an inner container for said product formed from a flexible tube of a water-soluble film having two ends, each of said ends being closed by a transverse joint located near each end, and each of said ends being provided with an end strip, characterized as an extension of the flexible tube from said transverse joint to said end, one of said end strips having a perforated tear line therein intermediate the transverse joint and said end; an outer container surrounding said inner container with product, said outer container being formed from a flexible tube of a water-resistant material having two ends, each of which is closed by a transverse joint placed near said end; and wherein each end of said inner container is attached to the outer container at each transverse joint of said outer container.

2. The package of claim 1, in which the length and width of the inner container are less than the length and width of the outer container.

3. The package of claim 1, in which the watersoluble inner container occupies a fixed position inside the flexible outer container.

4. The package of claim 1, in which the inner container is formed of a film of polyvinyl alcohol.

5. The package of claim 1, in which the water-resistant material of the outer container is a laminate.

6. The package of claim 5, in which the laminate is aa film, kraft paper and a coating.

7. The package of claim 6, in which the film is metallized.

8. The package of claim 7, in which the water resistant material is a laminate comprising 12 micron metallized polyester film, 40 g/m kraft paper and 35 g/m polyvinyl alcohol coating.

9. The package of claim 4, in which the polyvinyl alcohol film of the inner container has a thickness ranging from 37–70 microns.

10. The package of claim 9, in which the thickness of the polyvinyl alcohol film is 35 microns.

11. The package of claim 1, in which the transverse joints in the inner and outer containers are heat sealed joints.

12. The package of claim 1, in which the transverse joints in the inner and outer container are beaded joints.

13. A device for the manufacture of a package of a water-soluble pulverulent or granular product comprising a first filling pipe, means for providing a metered supply of product to said first filling pipe, means for placing around said first filling pipe a first continuous flexible tube of film, first sealing means for making a transverse joint across said first tube to form a package while leaving a first end strip, filling means to deposit a measured quantity of said product in said package, means for closing said package by making a transverse joint in said first tube above said product while leaving a second end strip in said first tube, and perforating means for making a tear line in the second end strip; and a second filling pipe for receiving the filled and closed first tube, means for placing a second continuous tube of film around the second filling pipe, and sealing means for forming a transverse joint across both the first and second tube at each end of the first tube.

14. The device of claim 13 further comprising a first longitudinal welding means for forming the first continuous flexible tube from a first supply of film and a second longitudinal welding means for forming the second continuous flexible tube from a second supply of film.

15. The device of claim 13, in which the first transverse welding means is connected to a stationary support means wherein the first transverse welding means moves perpendicularly to the direction of movement of a formed package.

16. The device of claim 13 in which said perforating means is located intermediate two pair of first transverse sealing means, thereby providing means for forming simultaneously a second transverse joint to seal the first package, a tear line in an end strip of said first package, and a first transverse joint of a next package in line.

17. The device of claim 13, in which the second transverse welding means is mounted on a support means, which is movable in an up and down direction, and wherein said second transverse welding means moves perpendicularly to the direction of movement of a formed package.

18. Device of claim 13 together with a cutting means which provides for separation of one formed package from another.

19. A method of manufacturing a filled package in which a water-soluble pulverized or granular product is contained in a closed water-soluble inner container placed inside and attached to a closed water-resistant outer container comprising the steps of:

(a) forming around a filling tube a first continuous flexible tube of water-soluble film, (b) forming a transverse joint across the tube below the filling tube to form a first closure in the first tube, (c) filling the first tube with a metered amount of the product;

(d) forming a second transverse joint to seal said first tube and to provide an end strip therein;

(e) perforating the end strip to form a tear line therein;

(f) forming a second continuous flexible tube of water-insoluble film around the first tube; and (g) forming first and second transverse joints across the first and second tubes to provide closures to the second tube, while at the same time attaching the ends of the first tube to the second tube.

20. A method as in claim 19 further comprising the step of separating each filled package after forming the second transverse joint across the second tube.

* * * * *

UNITED STATES PATENT AND TRADEMARK OFFICE

CERTIFICATE OF CORRECTION

PATENT NO. : 4,681,228

DATED : July 21, 1987

INVENTOR(S) : Kerry et al.

It is certified that error appears in the above-identified patent and that said Letters Patent is hereby corrected as shown below:

First page, Item 56, between lines 5 and 6 thereof, insert:

--3,547,660 12/1970 Weisberg ..... 99/171--.

Col. 2, line 2, "of" should read --for--.

Signed and Sealed this

Nineteenth Day of January, 1988

*Attest:*

DONALD J. QUIGG

*Attesting Officer*

*Commissioner of Patents and Trademarks*